US009095219B1

(12) United States Patent
McGowen

(10) Patent No.: US 9,095,219 B1
(45) Date of Patent: Aug. 4, 2015

(54) QUICK-RELEASE HOOKING MECHANISM FOR A SWING

(71) Applicant: Randall L. McGowen, Hattiesburg, MS (US)

(72) Inventor: Randall L. McGowen, Hattiesburg, MS (US)

( * ) Notice: Subject to any disclaimer, the term of this patent is extended or adjusted under 35 U.S.C. 154(b) by 127 days.

(21) Appl. No.: 13/850,814

(22) Filed: Mar. 26, 2013

(51) Int. Cl.

| | |
|---|---|
| ***B42F 13/00*** | (2006.01) |
| ***A47C 7/62*** | (2006.01) |
| ***A63G 9/00*** | (2006.01) |
| ***A63G 9/12*** | (2006.01) |

(52) U.S. Cl.
CPC ... *A47C 7/62* (2013.01); *A63G 9/00* (2013.01); *A63G 9/12* (2013.01)

(58) Field of Classification Search
CPC ..... A63G 9/12; A63G 9/00
USPC ..... 248/339, 341, 340, 322, 225.21, 227.1, 248/215, 317; 24/698.1, 592.1, 698.3, 24/697.2, 588.1, 582.1, 598.6
See application file for complete search history.

(56) References Cited

U.S. PATENT DOCUMENTS

| | | | | | |
|---|---|---|---|---|---|
| 735,378 | A | | 8/1903 | Hoffman | |
| 1,189,538 | A | | 7/1916 | Cashner | |
| 1,192,941 | A | | 8/1916 | Schmid | |
| 1,325,358 | A | | 12/1919 | Elzey | |
| 1,689,397 | A | | 10/1928 | Lee | |
| 1,769,509 | A | | 7/1930 | Hendrix | |
| 3,614,046 | A | * | 10/1971 | Lehman | 248/343 |
| 4,027,842 | A | * | 6/1977 | Mittleman | 248/75 |
| 4,979,712 | A | * | 12/1990 | Rios | 248/215 |
| 6,092,777 | A | * | 7/2000 | Kuntz | 248/323 |
| D458,533 | S | * | 6/2002 | Sonju | D8/356 |
| D679,095 | S | * | 4/2013 | Williams et al. | D3/328 |

* cited by examiner

*Primary Examiner* — Todd M Epps
(74) *Attorney, Agent, or Firm* — Robert C. Montgomery; Montgomery Patent and Design, LP.

(57) ABSTRACT

A hooking mechanism for a swing comprises a support bracket that has been designed to facilitate removal from a conventional porch swing. The bracket comprises a central area and a pair of opposing legs. The bracket is designed to support the swing from the underside of the armrest of the swing by connecting the swing to an upwardly tethered support chain. The chain passes through an aperture in the armrest and connects to the central area of the bracket. The leg portions catch and support the armrest and thereby support the rest of the swing.

2 Claims, 5 Drawing Sheets

QUICK-RELEASE HOOKING MECHANISM FOR A SWING

RELATED APPLICATIONS

There are no current co-pending applications.

FIELD OF THE INVENTION

The invention described herein pertains to a hooking mechanism, and more specifically a hooking mechanism for securely suspending a swing.

BACKGROUND OF THE INVENTION

Porch swings are attached to an overhanging structure through use of a chain or rope-like member. Traditionally, the chain or rope is permanently attached to the swing and detachably secured to a hook on the overhanging structure. When a swing needs to be taken down for storage or protection a user often requires a ladder to reach the overhanging hook, requiring significant time and effort. A device for quickly detaching a rope or chain from a swing is desired.

U.S. Pat. No. 1,325,358 to Edgar P. Elzey discloses a hanger for a porch swing having rigid attachment arms for either side of a swing. Each side has a single rod with multiple legs adjustably attached thereto. The rod and legs are made of flat, rigid metal and attach to eye hooks on a swing through the use of "J"-shaped hooks. The legs are not adjustable independent of each other, and present a potential hazard in their attachment to the single rod and to the swing. The legs are attached to the single rod through the use of a wing nut and bolt which can easily become loosened and cause the swing to fall. Additionally, the "J"-shaped hooks can easily slide out of the eye hooks on the swing, also causing the swing to fall.

Another attempt at providing a quickly releasable attachment to a porch swing is seen in U.S. Pat. No. 1,689,397 to Charles William Lee et al. This patent discloses an apparatus for attaching a swing to a single rope or chain. The apparatus consists of an "S" hook for coupling the rope or chain to a first elongated bar. The first elongated bar is attached to a second elongated bar via two (2) springs. Extending outwardly from the second elongated bar are two (2) connecting rods which slide on to hooks affixed to a swing. This apparatus has many interconnected parts, each of which is attached through an "S" or "J"-shaped hook. Each hook presents a potentially hazardous connection point. Additionally, the use of one cable or rope per side reduces the weight bearing capacity of the swing.

A further attempt at providing a quick release mechanism for a porch swing is seen in U.S. Pat. No. 1,769,509 to Roy Hendrix. This patent describes a "U"-shaped hook fastened to a swing for securing a chain thereto. The "U"-shaped hook is not quickly releasable to provide quick detachment of a swing.

Although the various devices observed may fulfill their individual, particular objectives, each device suffers from one (1) or more disadvantage or deficiency related to design or function. Whether taken singly, or in combination, none of the observed devices disclose the specific arrangement and construction of the instant invention.

SUMMARY OF THE INVENTION

The inventor has recognized the deficiencies in the art pertaining to porch swing attachments. Furthermore, the inventor has observed that there is a need for an apparatus which can securely attach a chain to a swing while also being quickly and easily released from the swing itself.

The inventor has addressed at least one (1) of the problems observed in the art by developing a novel hooking mechanism. It is a feature and aspect of the present invention to provide a body with a first side and a second side. Each side has an indentation and a leg portion. The body is extended through an aperture in a seat or arm rest portion of a swing. Once extended through the aperture, the seat or arm rest portion slides into the indentation on the each leg of the body. A leg portion extends away from the aperture of the seat or arm rest to prevent the body from sliding all the way through the aperture. Prior to extending the body through the aperture, a chain is slid over the leg and indentation portions to rest around the body.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawing and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
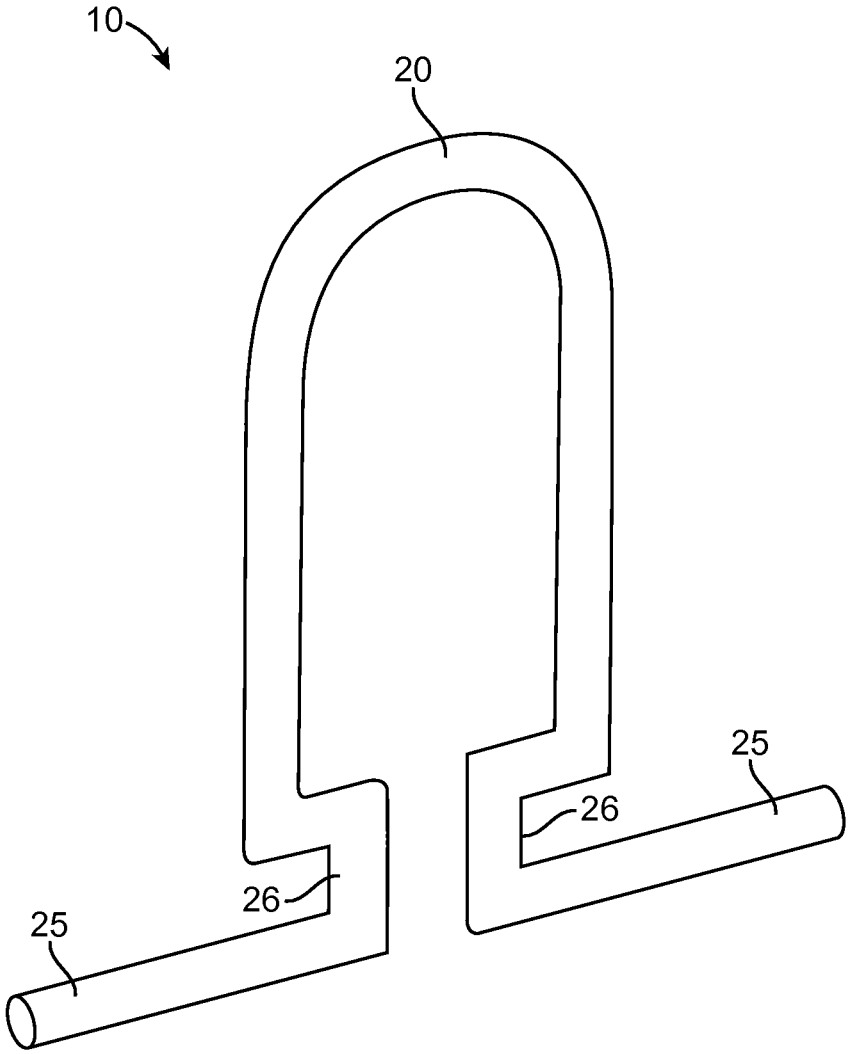
FIG. 1 is a perspective view of a hooking mechanism 10, according to a preferred embodiment of the present invention.

10 hooking mechanism
11 swing
12 arm rest
13 seat
14 aperture
15 chain
20 body
25 leg
26 indentation

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a hooking mechanism (herein described as the "device") 10, which provides a means for suspending an existing swing 11. The device 10 also enables the swing 11 to be disconnected in a quick manner for emergency scenarios such as a storm.

Referring now to FIG. 1, a perspective view of the device 10, according to the preferred embodiment of the present invention, is disclosed. The device 10 comprises a generally "U"-shaped and tubular body 20 and a pair of generally "L"-shaped opposing and integral legs 25. The body 20 retains a chain 15 (see FIGS. 3 through 5) or similar rope which commonly suspends the swing 11 from a ceiling or frame structure. The legs 25 anchor the device 10 to an underside surface of the swing 11, thereby fixing the device 10 in a secure position. A pair of indentations 26 interconnects the body 20 to the legs 25. The indentations 26 also provide a surface area for the device 10 to rest within an aperture 14. The device 10 is preferably fabricated from a material having an elastic or spring-type characteristic such as plastic, spring steel, or the like. The device 10 is preferably manufactured in various sizes to correspond to the swing 11.

Figure 2:
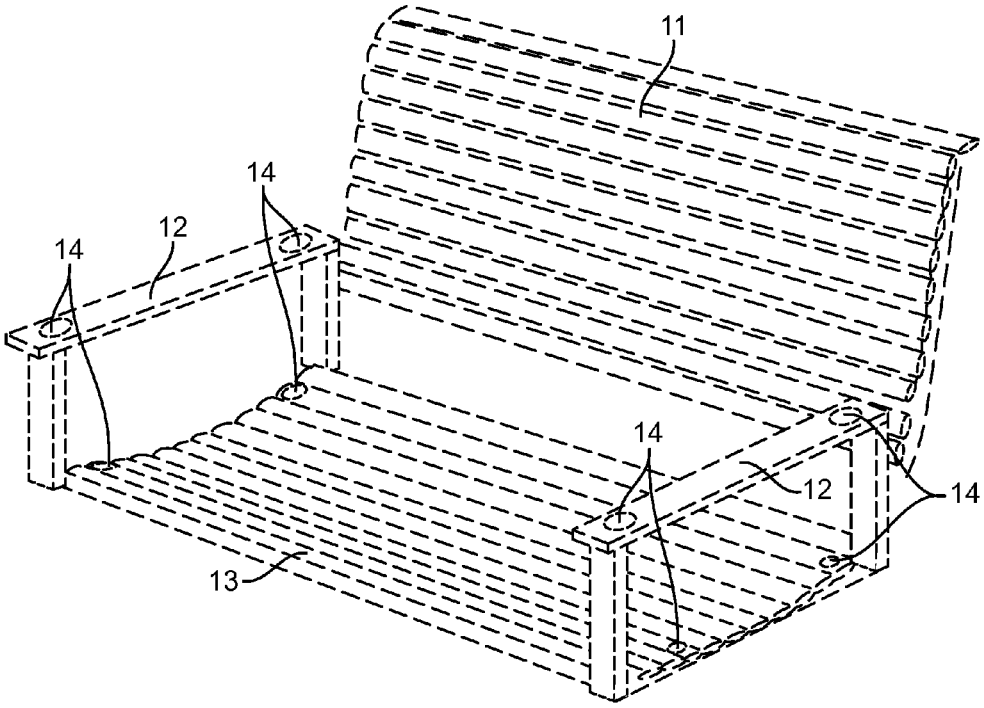
FIG. 2 is a perspective view of a swing 11, according to a preferred embodiment of the present invention.

Referring now to FIG. 2, a perspective view of the swing 11, according to the preferred embodiment of the present invention, is disclosed. FIG. 2 depicts an existing swing 11 in a particular design for illustration purposes only it is known that other swing 11 designs may be utilized without limiting the scope of the invention. The swing 11 is depicted as comprising a pair of opposing arm rest 12 and a seat 13. The arm rests 12 and seat 13 typically comprise a plurality of apertures 14 which enable the swing 11 to be suspended via a chain 15. It is known that a plurality of devices 10 is utilized to suspend a swing 11 at the various apertures 14.

Figure 3:
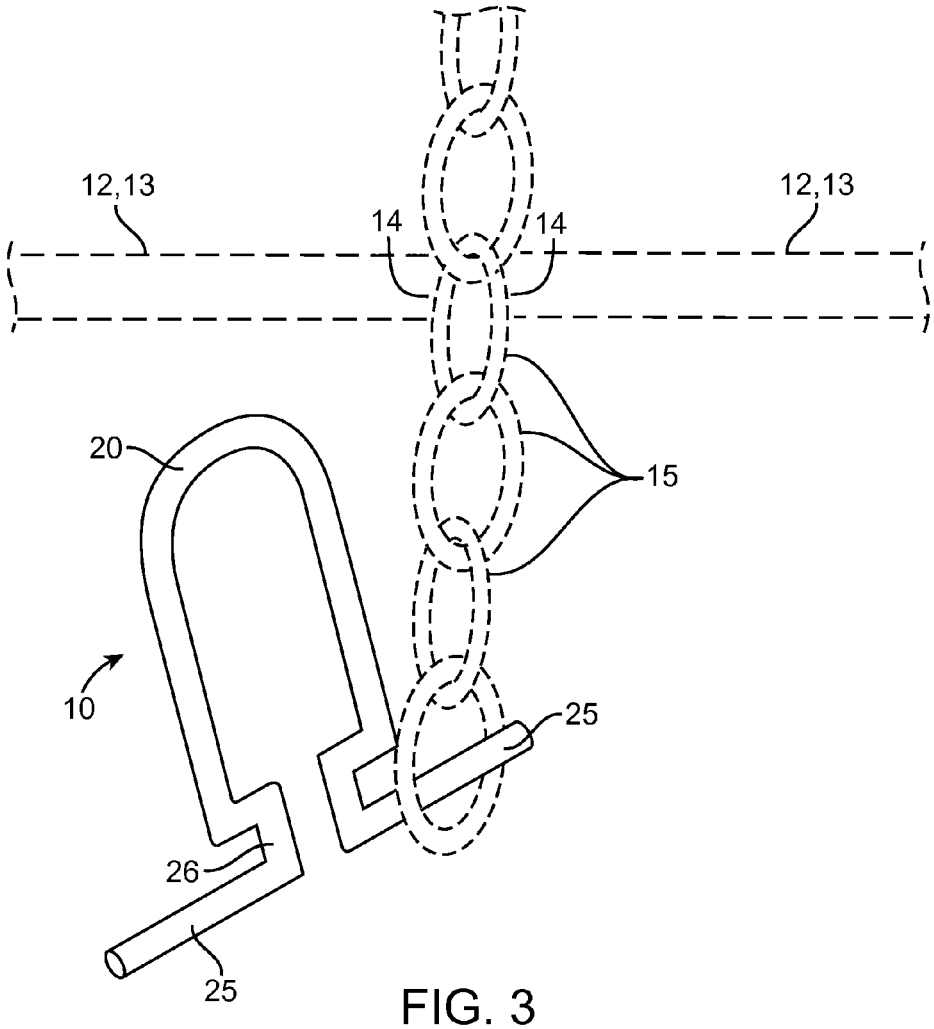
FIG. 3 is a perspective view of the hooking mechanism 10 depicting placement onto the swing 11, according to a preferred embodiment of the present invention.
Figure 4:
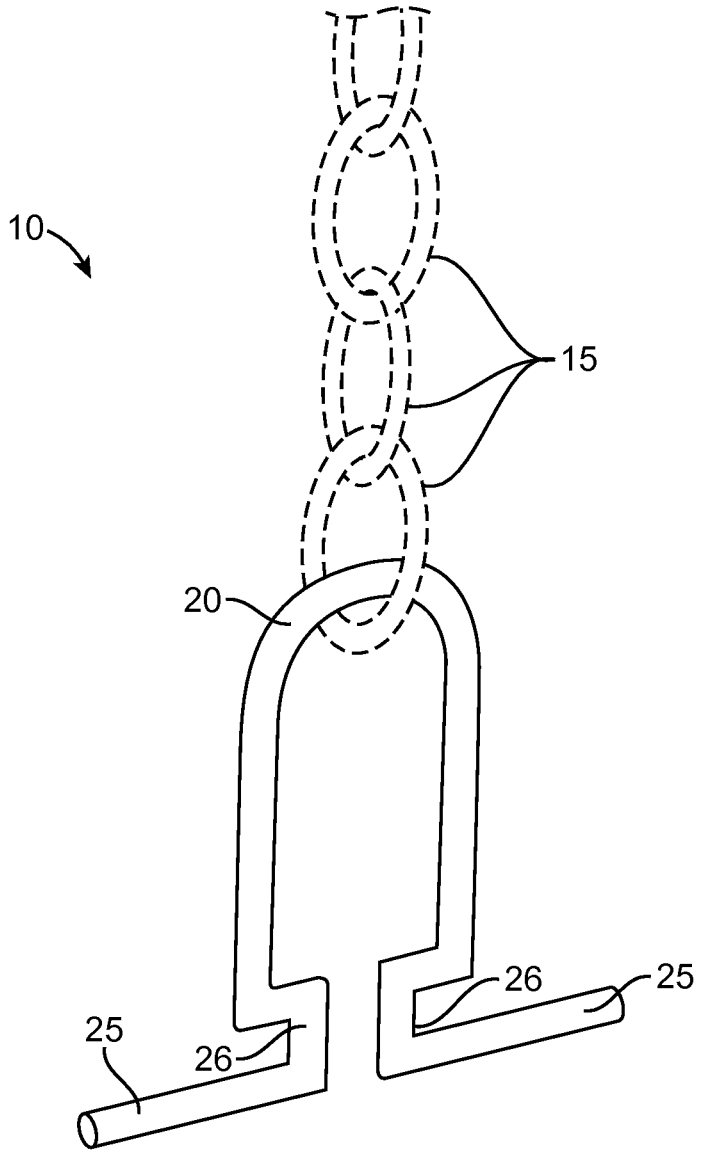
FIG. 4 is a perspective view of the hooking mechanism 10 depicting an attached chain 15, according to a preferred embodiment of the present invention; and, FIG. 5 is a side view of the hooking mechanism 10 attached to the swing 11, according to a preferred embodiment of the present invention.
Figure 5:
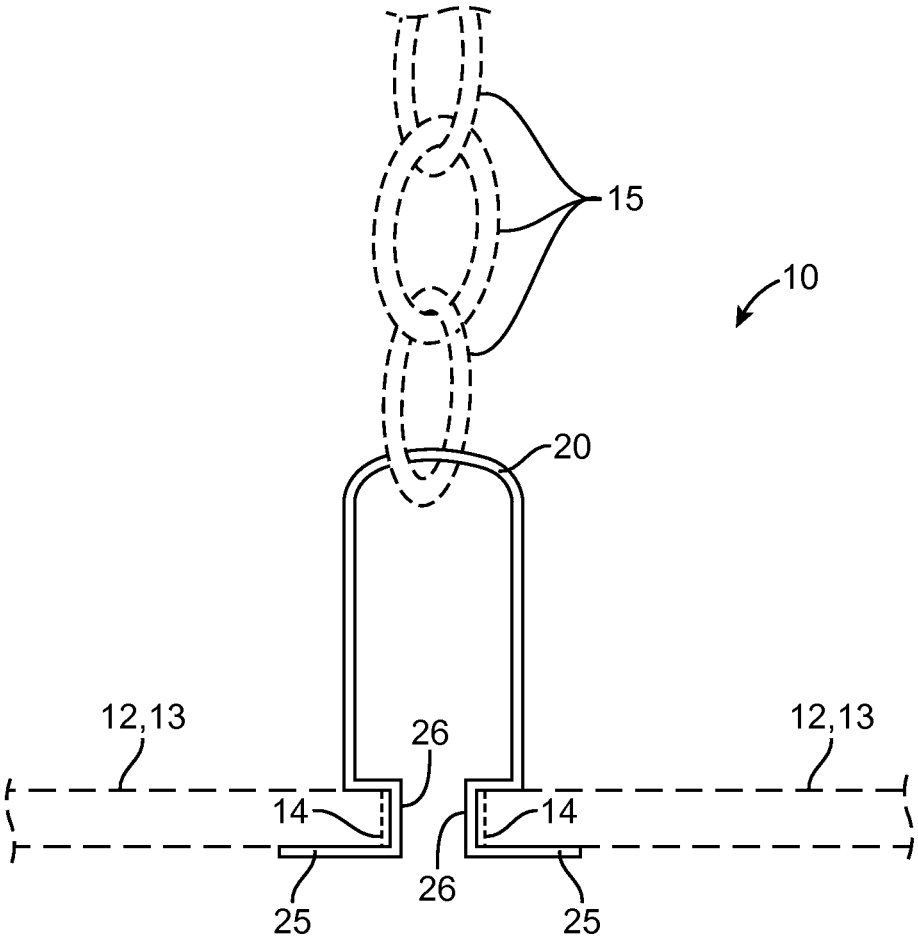

Referring now to FIG. 3, a perspective view of the device 10 depicting placement onto the swing 11, FIG. 4, a perspective view of the device 10 having an attached chain 15, and FIG. 5, a side view of the device 10 attached to the swing 11, according to the preferred embodiment of the present invention, is disclosed. FIGS. 3 through 5 depict the steps to install the device 10 upon a swing 11. In use, the chain 15 is inserted through an aperture 14 which is typically found on the arm rest 12 or seat 13. With the chain 15 through the aperture 14 a leg 25 of the device 10 is inserted through a desired section of chain 15. The chain 15 is then repositioned along the indentations 26 and body 20 to a pinnacle position to provide balance. Due to the flexible nature of the device 10, it is inserted so that the indentations 26 abut against the inner walls of the aperture 14 and the legs 25 engage an underside surface of the arm rest 12 or seat 13, thereby fixing the device 10 to the swing 11. This is repeated for each aperture 14 utilized to suspend the swing 11 in a level position. As needed, the device 10 is pushed downwardly and the chain 15 is removed to disconnect the device 10 from the swing 11.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 and 5.

The method of utilizing the device 10 may be achieved by performing the following steps: acquiring the device 10; inserting a chain 15 through an aperture 14 upon the arm rest 12 or seat 13 of the swing 11; inserting a leg 25 of the device 10 through a desired section of chain 15; moving the chain 15 along the indentation 26 and body 20 to a pinnacle position to provide balance; inserting the device 10 into the aperture 14 having the legs 25 engage an underside surface of the arm rest 12 or seat 13 and the indentation 26 within the aperture 14, thereby fixing the device 10 to the swing; repeating as desired for each additional aperture 14; removing the devices 10 as needed; and, utilizing the device 10 to suspend a swing 11 in a quick and efficient manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A method of suspending a swing with at least one hook, comprising the following steps:

providing said hook, comprising a central body, a pair of legs each having a proximal end extending outwardly from said opposing distal ends of said central body, and defining an indentation between said distal ends of said central body and said proximal ends of said pair of legs;

inserting an elongated support device through a support aperture of said swing;

inserting a first leg of said hook through a desired section of said elongated support device;

motioning said elongated support device along an indentation adjacent to said first leg to a pinnacle position; and, inserting said hook into said support aperture such that said pair of legs each engage an underside surface of said swing such that each indentation retains at least a portion of said swing.

2. The method of claim 1, further comprising the steps of attaching at least one additional hook to said swing by repeating the above steps.

* * * * *